United States Patent [19]

Szoke

[11] Patent Number: 4,757,866

[45] Date of Patent: Jul. 19, 1988

[54] HYDRAULIC DRILL FEED UNITS

[76] Inventor: Steve Szoke, P.O. Box 729, Masontown, Pa. 15461

[21] Appl. No.: 913,538

[22] Filed: Sep. 30, 1986

[51] Int. Cl.[4] ..... E21C 5/11

[52] U.S. Cl. ..... 173/152; 173/141

[58] Field of Search ..... 173/31, 33, 37, 148, 173/152, 141; 408/99, 100, 130; 254/93 R

[56] References Cited

U.S. PATENT DOCUMENTS

| | | | |
|---|---|---|---|
| 3,780,816 | 12/1973 | Arrington et al. | 173/152 |
| 3,850,253 | 11/1974 | Lupton et al. | 173/152 |
| 3,985,328 | 10/1976 | Bull | 254/93 R |
| 4,526,345 | 7/1985 | Schmidt | 254/93 R |

*Primary Examiner*—E. R. Kazenske
*Assistant Examiner*—James L. Wolfe
*Attorney, Agent, or Firm*—Thomas R. Shaffer

[57] ABSTRACT

An hydraulic drill feed unit is provided having a main support frame extending from its mounting on a base plate. Single stage cylinders are located on either side of the main support frame and also extend from the base plate. A subframe adapted to travel upon the main support frame is connected to the single stage cylinders. A two stage cylinder is attached to the subframe and extends to a slide member adapted to travel upon the main support frame. The slide member, to which the drill is attached, can move with the subframe responsive to the single stage cylinders and can move relative to the subframe responsive to the two stage cylinder. Each of the cylinders are equipped with ball and socket connectors which allow the drill feed unit to obtain increased lift out of a minimum space. In such a manner, the drill can be positioned to engage the rock strata in very narrow mineshafts or tunnels.

3 Claims, 2 Drawing Sheets

HYDRAULIC DRILL FEED UNITS

BACKGROUND OF THE INVENTION

1. Field of the Invention

The present invention relates to the art of mining and tunneling, and more particularly to a drill feed unit which provides increased penetration of a roof drill or the like into rock strata than existing feed units.

2. Description of the Prior Art

In the mining and tunneling industry, space to operate a drill is at a premium. Because of the lack of space in a mineshaft or tunnel, there is a need for a drill feed unit which is compact, but nevertheless can provide sufficient lift to the drill so as to allow maximum penetration of the drill into the roof, face or side wall of a mineshaft or tunnel. Accordingly, a drill feed unit which extends primarily upon a single longitudinal axis is highly desirable.

Most drill feed units in use today consist in part of mechanical linkage arrangements, which use sprockets and chains, for example, to extend the drill feed unit into the tunnel. Such arrangements are cumbersome, of great bulk and subject to frequent malfunctions because of the harsh and dirty environment in which mining drill feed units must operate. As a result, hydraulic systems have been proposed. Hydraulic lift systems can be constructed narrower and more compact than the bulky mechanical linkage systems. Despite the advantages offered by a hydraulic lift system, most drill feed units in operation remain, at least in part, composed of mechanical linkage lift arrangements.

One drawback with existing all-hydraulic drill feed units is that such systems are not adapted to extend exclusively along a single longitudinal axis. Rather, known hydraulic systems extend at least partially into the lateral direction to provide support to the unit. A further drawback of existing hydraulic systems is the use of eye-hook connectors between the piston rods of the hydraulic cylinders and the plates to which the rods are mounted. These eye-hook connectors take up much needed space when the hydraulic cylinders are in an unextended position and decrease the total extension possible for a drill feed unit of fixed height. Accordingly, there is a need for an all-hydraulic unit that extends primarily in a single longitudinal direction. Such a unit would be able to increase the penetration of the drill into the rock strata without increasing the height of the unextended unit.

SUMMARY OF THE INVENTION

The present invention provides an hydraulic drill feed unit specially designed to operate in the narrow and confined spaces provided in a tunnel or mineshaft. The drill feed unit is mounted on a base plate which serves to anchor many of the extending parts of the apparatus. A main support frame is connected at one end to the base plate and extends upwardly in a longitudinal direction therefrom. A longitudinally extending single stage hydraulic cylinder is provided parallel to the main support frame on each side thereof. The single stage cylinders are mounted to the base plate at one end and are attached to the upper ends of a U-shaped subframe. The subframe is adapted to slide within longitudinal slots provided in spaced apart side members of the main suport frame responsive to the force exerted by the single stage cylinders.

The subframe has a lower base member between its upper ends to which a telescopic two stage hydraulic cylinder is mounted. The two stage cylinder is positioned to extend longitudinally upwardly from the base member of the subframe and an upper end thereof is attached to a slide member. The slide member is adapted to slide along front edges of the spaced-apart side members of the main support frame. The slide member moves relative to the subframe responsive to movement of the two stage cylinder and in unison with the subframe in response to movement of the single stage cylinders. Means are provided on the slide member to support a drill or the like below an upper end of the two stage cylinder.

The operation of the single stage cylinders causes each of the subframe, two stage cylinder and slide member to move relative to the mainframe. The operation of the two stage cylinder causes the movement of the slide member relative to the main support frame. A further aspect of the present invention is the provision of ball and socket connections between the piston rod of the hydraulic cylinders and their respective top mounting plates. A similar ball and socket arrangement is utilized to connect the base of the hydraulic cylinder housings to the base plates of the main and subframes. This arrangement reduces the total height of the feed unit and causes the hydraulic cylinders to be self aligning. In such a manner, the drill feed unit disclosed in the present invention is able to penetrate very narrow openings in tunnels or mineshafts and deliver the drill to the surface to be drilled.

DESCRIPTION OF THE PREFERRED EMBODIMENT

Figure 1:
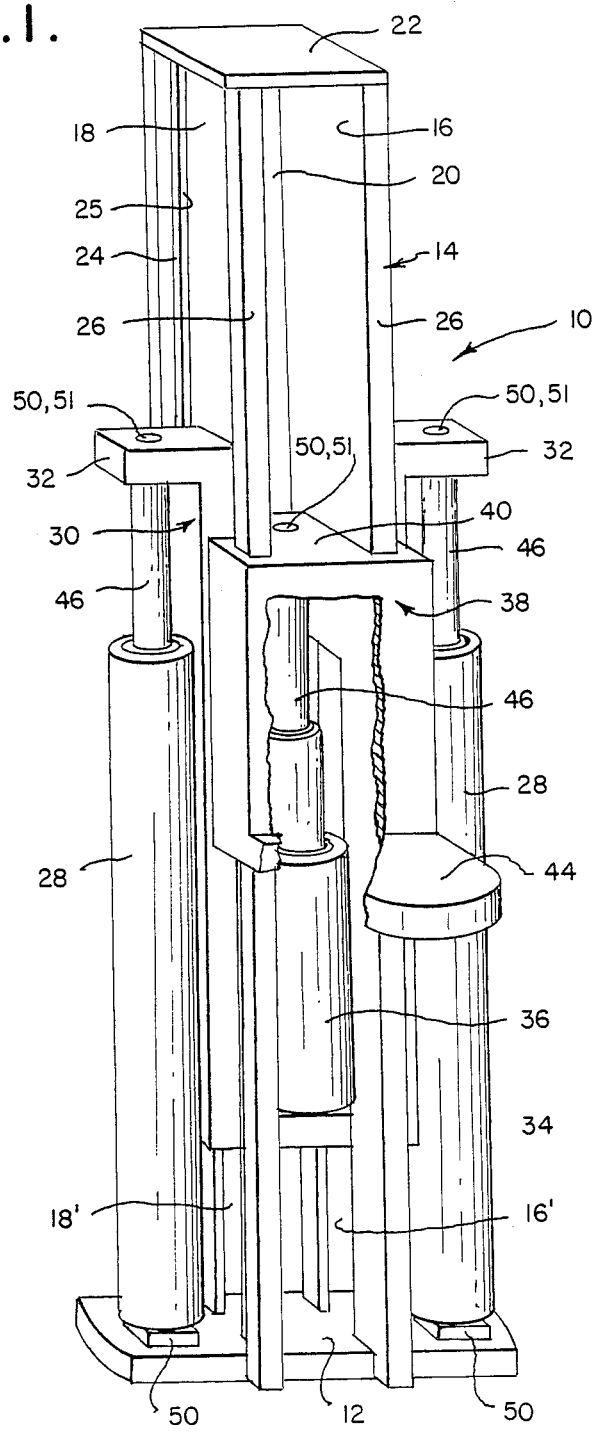
FIG. 1 is an isometric view of an hydraulic drill feed unit partially broken away to show all parts thereof.
Figure 2:
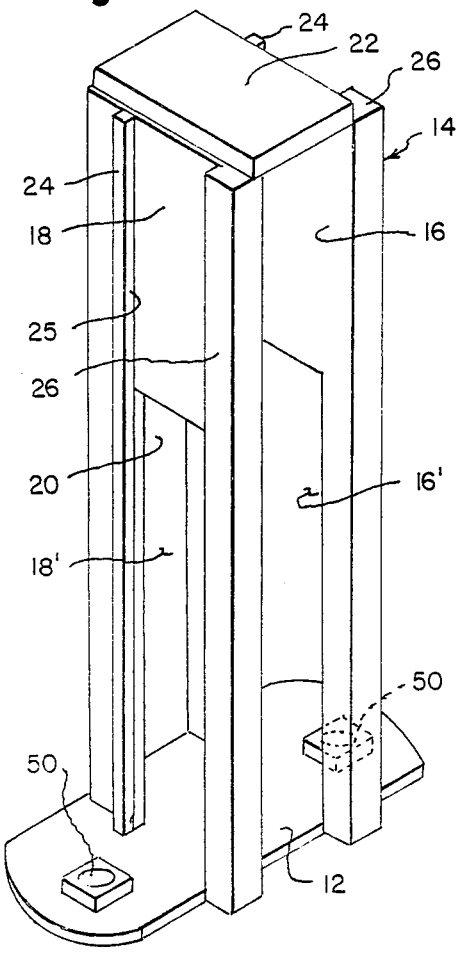
FIG. 2 is an isometric view of the main support frame of the hydraulic drill feed unit shown in FIG. 1.
Figure 3:
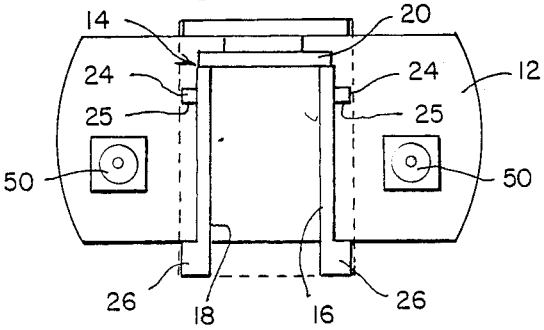
FIG. 3 is a top plan view of the main support frame of the hydraulic drill feed unit shown in FIG. 1.

Referring to FIGS. 1, 2 and 3, hydraulic drill feed unit 10 has a base plate 12 designed to anchor the feed unit 10 in an upright position. A main support frame 14 is secured to the center of base plate 12 and extends upwardly therefrom. Main support frame 14 is formed of right side member 16, left side member 18, back plate 20 and top plate 22. A groove 24 is provided on the outer side of both right side member 16 and left side member 18 between rear portions 25 and front edge portions 26. Additionally, longitudinally extending slots 16' and 18' are provided in at least the lower portion of side members 16 and 18 respectively.

Figure 4:
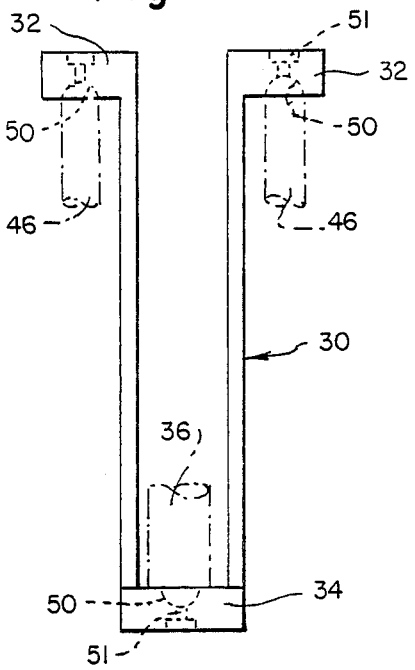
FIG. 4 is a front elevational view of the subframe of the hydraulic drill feed unit shown in FIG. 1.

A pair of single stage hydraulic cylinders 28 are mounted on base plate 12, one on either side of main support frame 14. As seen in FIG. 4, each cylinder 28 extends upwardly from the base plate 12 and is attached to subframe 30. Subframe 30 is generally U-shaped having two upper ends 32 on either side of a lower base portion 34. Base portion 34 extends through and is adapted to travel within slots 16' and 18' of the side members 16 and 18. Each cylinder 28 is connected to subframe 30 at one of the ends 32. Subframe 30 is adapted to move along main support frame 14 guided by grooves 24.

Figure 5:
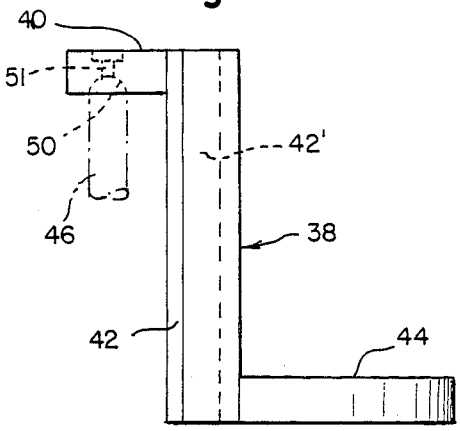
FIG. 5 is a side elevational view of the slide member of the hydraulic drill feed unit shown in FIG. 1.
Figure 6:
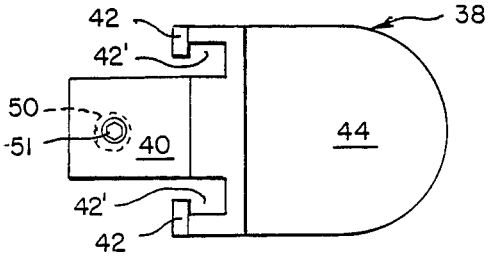
FIG. 6 is a top plan view of the slide member shown in FIG. 5.

A telescopic two stage hydraulic cylinder 36 is mounted on base member 34 of subframe 30. As shown in FIGS. 5 and 6, hydraulic cylinder 36 extends upwardly from base member 34 and is attached at its uppermost end to slide member 38. Slide member 38 is adapted to move along and is symetrically guided by front edge portions 26 of slide members 16 and 18. Recesses 42' in portion 40 of slide member 38 are provided to receive front edge portions 26. Additionally, portion 40 is provided with arms 42 which surround sidewalls 26. Slide member 38 travels responsive to the force exerted by cylinder 36 along main support frame 14 relative to subframe 30. Slide member 38 also travels along main support frame 14 in cooperation with the movement of subframe 30 responsive to the force exerted by cylinders 28 along main support frame 14. Slide mounting plate 44 is attached to slide member 38 below an upper end of two stage cylinder 36 and provides a base upon which a drill (not shown) is attached to the drill feed unit 10.

Figure 7:
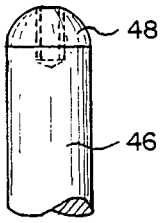
FIG. 7 is a front elevational view of the piston rod used in all of the hydraulic cylinders of the hydraulic drill feed unit shown in FIG. 1.

As shown in FIG. 7, single stage hydraulic cylinders 28 and two stage hydraulic cylinder 36 each contain a piston rod 46 having a rounded end 48 adapted to be used as a ball and socket connector. The ball and socket connector which attaches into the above connecting plate by means of ball and socket joints 50 provides a much needed improvement in maximizing space. Similar ball and socket arrangements are provided to mount the base of the cylinders and suitable bolts 51 may be utilized to secure the cylinders in place. Instead of reserving some space for the conventional eye-hook connectors, the ball and socket connector allows the hydraulic cylinder to fully utilize the space provided between its bottom and top mounting plates. In this manner, increased lift is obtained through the use of minimum space.

In operation, drill feed unit 10, because of its narrow construction, is able to be used in narrow mineshaft or tunnel openings. Drill feed unit 10 is first positioned in the mineshaft or tunnel so that the main support frame 14 extends toward the direction of the desired drilling. Single stage hydraulic cylinders 28 cooperate to extend subframe 30, including slide member 38, along main support frame 14. Two stage hydraulic cylinder 36 then extends slide member 38 along main support frame 14 relative to the then stationary subframe 30. Slide member 38 is extended until the drill attached to slide mounting plate 44 engages and penetrates a desired depth into the rock strata to be drilled.

By the combination of the two sets of hydraulic cylinders, drill feed unit 10 is capable of extending a drill to the rock strata and still maintain stability. Because the entire apparatus is built upon base plate 12, drill feed unit 10 extends primarily in only one direction. Thus, space is conserved, and the apparatus is capable of being used in a wider variety of drilling operations than standard drill feed units can be used today.

In the foregoing specification, I have set forth certain preferred practices and embodiments of my invention. However, it will be understood that this invention may be otherwise embodied within the scope of the following claims.

I claim:

1. An hydraulic drill feed apparatus comprising:

a base member;

a centrally located main support frame having a top member and a pair of parallel spaced apart side members, each of said side members extending longitudinally upwardly from said base and terminating at said top member , each of said side members having a longitudinally extending slot therein on at least a lower portion thereof and each side member also having a front edge portion;

a pair of parallel, longitudinally extending single stage hydraulic cylinders, each cylinder having a lower housing end mounted to said base member, said single stage cylinders equally spaced from and mounted on opposite sides of said main support frame and each having a piston rod movably extending from an upper end of the housing end and terminating at an upper end;

a generally U-shaped subframe having a lower base portion and two parallel leg members presenting two upper ends, said lower base extending through and adapted to travel within said side member slots, each of said upper ends connected to a piston rod to one of said single stage hydraulic cylinders and each leg member positioned adjacent to and engaging a portion of an outside surface of one of said side members whereby said subframe is symmetrically guided in a single direction by and adapted to travel on said centrally located main support frame responsive to the movement of the hydraulic cylinders;

a telescopic two stage hydraulic cylinder having a lower housing end mounted in said lower base portion of said subframe and having a piston rod movably extending from an upper end of the housing end and terminating at an upper end; and slide member means attached to the piston rod of said two stage hydraulic cylinder and adapted to support a drill below an upper end of said two stage cylinder, said slide member means including a longitudinally extending portion spanning the distance between and having recesses therein adapted to receive and slidably engage the front edge portions of said spaced apart side members, whereby said slide member means is symmetrically guided by and adapted to travel on said main support frame relative to said subframe responsive to the movement of said two stage hydraulic cylinder and said slide member means is symetrically guided by and adapted to travel on said main support frame in unison with said subframe in response to movement of said single stage cylinders.

2. Apparatus according to claim 1 wherein said upper and lower ends of said single stage hydraulic cylinders are provided with ball-like end portions adapted to be received by socket connectors provided in said subframe and said base member, whereby said single stage cylinders have a reduced height and are aligned in a desired position by said socket connectors.

3. Apparatus according to claim 1 wherein said upper and lower ends of said two stage hydraulic cylinder are provided with ball-like end portions adapted to be received by socket connectors provided in said slide member means and said subframe which attach said two stage hydraulic cylinder to said slide member means, whereby said two stage cylinders have a reduced height and are aligned in a desired position by said socket connectors.

* * * * *